US011877703B1

(12) United States Patent
Kopp

(10) Patent No.: US 11,877,703 B1
(45) Date of Patent: Jan. 23, 2024

(54) LIGATURE-RESISTANT PAPER TOWEL DISPENSER AND METHOD OF EMPLOYING THE SAME

(71) Applicant: Christopher Kopp, Greenlawn, NY (US)

(72) Inventor: Christopher Kopp, Greenlawn, NY (US)

( * ) Notice: Subject to any disclaimer, the term of this patent is extended or adjusted under 35 U.S.C. 154(b) by 10 days.

(21) Appl. No.: 17/223,170

(22) Filed: Apr. 6, 2021

(51) Int. Cl.
*A47K 10/42* (2006.01)
*A47K 10/32* (2006.01)

(52) U.S. Cl.
CPC .... *A47K 10/424* (2013.01); *A47K 2010/3233* (2013.01)

(58) Field of Classification Search
CPC ..... A47K 10/20; A47K 10/44; A47K 10/424; A47K 2010/3233; B65D 5/44; B65D 5/443; B65D 5/445; B65D 77/20; B65D 83/0835; B65D 83/0876; B65D 2583/082
See application file for complete search history.

(56) References Cited

U.S. PATENT DOCUMENTS 2,099,862 A * 11/1937 Miller ..... A47G 21/184 221/257
2,543,746 A * 3/1951 Morrison ..... A47F 1/085 221/307
3,369,699 A 2/1968 Enloe et al.
3,840,146 A * 10/1974 Bodek ..... A47K 10/424 221/244
4,711,371 A * 12/1987 Harrigan ..... A63F 1/14 273/148 A
4,884,717 A * 12/1989 Bussard ..... B65D 47/06 426/115
5,006,894 A * 4/1991 Morris ..... G03G 15/0865 222/DIG. 1
5,222,606 A * 6/1993 Ghini ..... B65B 19/04 209/535
5,642,836 A * 7/1997 Merriweather, Jr. ..... A47K 10/424 221/33
5,913,314 A * 6/1999 Garrett ..... A45D 19/028 401/268
6,905,025 B2 6/2005 Morin
7,083,066 B2 8/2006 Neveu
10,188,244 B2 1/2019 Larsson et al.
10,376,110 B2 8/2019 Hall
2004/0159670 A1* 8/2004 Neveu ..... A47K 10/424 221/303

(Continued)

*Primary Examiner* — Gene O Crawford
*Assistant Examiner* — Kelvin L Randall, Jr.
(74) *Attorney, Agent, or Firm* — Galgano IP Law PLLC; Thomas M. Galgano; Edwin D. Schindler

(57) ABSTRACT

A ligature-resistant, multifold paper towel dispenser has a housing having a top panel, a front panel, a rear panel, and a pair of side panels secured together to define a hollow, interior chamber. The housing has an open bottom end through which a stack of paper towels may be inserted into the interior chamber. The dispenser also includes a support and dispenser assembly for resiliently supporting the stack of paper towels and for permitting manual dispensing of successive individual paper towels from the open bottom end of the housing. The support assembly includes at least one resilient flexible member which permits the paper towels to be supported thereon and dispensed therebelow and which at the same time is ligature-resistant due to its flexibility.

8 Claims, 7 Drawing Sheets

(56) References Cited

U.S. PATENT DOCUMENTS

| | | | | |
|---|---|---|---|---|
| 2009/0289078 | A1 | 11/2009 | Melin et al. | |
| 2012/0305587 | A1* | 12/2012 | Williford | A47K 10/42 221/45 |
| 2013/0047927 | A1* | 2/2013 | Chang | A01K 39/014 119/51.01 |
| 2014/0076915 | A1* | 3/2014 | Becherer | B65D 83/0805 221/33 |
| 2017/0135535 | A1* | 5/2017 | Larsson | A47K 10/421 |
| 2017/0231438 | A1* | 8/2017 | Larsson | A47K 10/422 221/52 |
| 2020/0069121 | A1 | 3/2020 | Boeltl | |

* cited by examiner 11
38
16
24
30
30
33
30
40
14
15
20

11
20
38
30
33
24
40
14
15

11
16
40
30′
33′
24
20
15
14

11
16
24
40
30′
24
33′
14
15
20

LIGATURE-RESISTANT PAPER TOWEL DISPENSER AND METHOD OF EMPLOYING THE SAME

BACKGROUND OF THE INVENTION

Field of the Invention

The present invention relates to a paper towel dispenser. More specifically, the present invention concerns a ligature-resistant, wall-mounted, multifold paper towel dispenser having a bottom open end and method of employing the same that permits the normal functions of allowing the towels to be stored in a dispenser housing and then dispensed individually in a controlled manner one at a time via a ligature-resistant paper towel support and dispensing assembly mounted adjacent to the bottom open end. The invention eliminates the need for a hinged or rigid bottom wall having a slot-like dispensing opening, thereby decreasing the likelihood of creating a ligature attachment point at or near the dispensing opening.

Description of the Related Art

The main patient safety concern in behavioral health facilities (formerly more commonly referred to as "psychiatric facilities") is self-harm considering that patients are often admitted due to being in a suicidal state. The predominant mode of self-harm is suicide by hanging or strangulation, particularly in the relatively private areas of patient bathrooms and bedrooms. Therefore, behavioral health facilities make a concerted effort to reduce any opportunities for suicide by hanging or strangulation by removing potential ligature attachment points from the patient environment. In recent years, specialized equipment such as lavatories, shower valves, doors, and clothes hooks have been modified for this purpose.

One fixture that continues to pose a risk is paper towel dispensers. Several tactics are employed to mitigate this risk. Stacks of folded paper towels can be placed on shelves or on open countertop containers, but this leaves the paper towels vulnerable to getting wet or soiled, and it is often difficult to only take one paper towel at a time resulting in waste. To reduce risk of ligature attachment when employing dispensers, there are, e.g., dispensers recessed in the wall, surface or wall mount dispensers with sloped tops so that a ligature will slide downward and off the top wall and the dispenser, and a dispenser with a bottom slot that has a downward sloping opening.

However, these dispensers do not prevent an object from being inserted into the dispensing opening and being secured in place as a ligature attachment point. The fundamental problem is that any restrictive opening can function in a manner comparable to a shirt button hole and a button. For example, an object could be manually oriented by a patient in one angular orientation to allow it to pass through the dispenser opening, but is then turned to another, e.g. orientation in which it cannot pass back out. In the case of paper towels dispensers, it is easy to imagine a string tied around a pencil being inserted into the dispensing slot and the pencil then being rotated to lock it in place as a ligature attachment anchor point.

As briefly discussed above, there are a wide variety of wall mounted, bottom dispensing paper towel dispensers, some of which are designed to be more ligature resistant. For example, U.S. Pat. No. 10,376,110 to Hall is directed to an anti-ligature hand towel dispenser which employs angled walls 410, 512 adjacent the bottom dispensing end of the container disposal at an angle less than 180 degrees and preferably between 60 degrees and 150 degrees, to prevent a tie from being supported by these sloped dispensing ends, U.S. Patent Application Publication No, 2020/0069121 to Boeltl discloses a front-dispensing rather than a bottom-dispensing, paper towel dispenser which is designed to provide an anti-ligature function.

Notwithstanding the foregoing prior art, there still exists a need to prevent an object from being inserted into the bottom dispensing opening and being secured in place as a ligature attachment point. This problem is solved according to the present invention by the provision of a ligature-resistant paper towel dispenser and method of employing the same that eliminates the standard rigid and/or hinged bottom dispensing slot which is prone to being used as a ligature attachment point.

BRIEF SUMMARY OF THE INVENTION

Accordingly, it is an object of the present invention to provide a novel ligature-resistant, bottom loading and dispensing paper towel dispenser.

It is a further object of the present invention to afford such a novel ligature-resistant paper towel dispenser which eliminates the provision of a rigid and/or hinged bottom wall having a rigid narrow slot-like dispensing opening.

It is also an object of the present invention to provide such a novel paper towel dispenser which is relatively simple in design yet highly effective in operation, inexpensive to manufacture and easy and facile to use.

It is another object of the present invention to provide such a novel, anti-ligature bottom loading and dispensing paper towel dispenser which can be wall mounted and which eliminates the need for an openable housing having hinged, spring-mounted or otherwise movable, rigid housing parts typically needed to allow loading of the paper towels in the internal chamber of the dispenser.

It is a more particular object of the present invention to provide such a novel ligature-resistant, wall mounted, bottom loading and dispensing paper towel dispenser which employs a single or pair of resilient and flexible members which generally span the open bottom end of the housing to resiliently support a stack of paper towels in the internal chamber of the housing and which are flexible upwardly to allow the paper towels to be inserted into the internal chamber and downwardly to allow the paper towels to be successively dispensed from the open bottom end.

More particularly, the above objects and shortcomings of the known prior art is addressed by the present invention by the provision of a novel ligature-resistant, paper towel dispenser and a method employing the same. This invention advances the state of the art by employing resilient, blade-like flexible material, e.g., brushes with bristles or elastomeric blades to serve simultaneously as the movable bottom "support wall" or a pair of movable "support walls" on which the stack of paper towels is supported in the interior chamber of the housing and which movable "support walls" also serves as the loading/dispensing opening of the dispenser. Consequently, if an object is inserted into the ligature-resistant, paper towel dispenser to create a ligature attachment point, the same would be deflected downwardly by the downward flexing of the flexible material of which the "support wall" is made causing the object to slide off or be expelled from the dispenser when a force or weight is applied.

Thus, certain of the foregoing and related objects are readily-attained according to the present invention by the provision of a ligature-resistant, paper towel dispenser, comprising: a housing having a top panel, a front panel, a rear panel, and a pair of side panels secured together to define a hollow, interior chamber configured and dimensioned for receipt therein of a stack of paper towels, and with said housing having an open bottom end through which a stack of paper towels may be inserted into said interior chamber thereof. Means are provided for resiliently and flexibly supporting a stack of paper towels in said interior chamber above said open bottom end of said housing and for permitting manual dispensing of successive individual paper towels from the bottom of said stack and from said interior chamber downwardly through and out of said open bottom end of said housing.

Preferably, the means for resiliently and flexibly supporting and permitting manual dispensing of successive paper towels comprises at least one resilient, flexible member having a fixed end secured in said housing adjacent to said open bottom end thereof and an opposite free end, with said at least one flexible member spanning at least a portion of said open bottom end of said housing to support a stack of paper towels disposed thereabove. The free end of said at least one resilient flexible member is movable upwardly relative to said open bottom end to permit insertion of a stack of paper towels into said interior chamber and, alternatively, is movable downwardly to permit successive removal of paper towels one at a time through said open bottom end of said housing.

Desirably, the means for resiliently and flexibly supporting and permitting manual dispensing of the successive paper towels comprises a pair of resilient, flexible members. The pair of resilient, flexible members each comprise a planar, elongated rectangular strip having a fixed end secured to said housing adjacent to said bottom open end thereof and an opposite free end disposed adjacent to said free end of the other member of said pair. The free ends of said pair of resilient, flexible members are movable upwardly to permit the stack of paper towels to be inserted upwardly through said open bottom end of said housing and into said interior chamber and are movably downwardly to permit the manual dispensing of successive individual paper towels between said free ends for removal through said open bottom end of said housing.

In a preferred embodiment, the pair of resilient flexible members comprise a pair of brushes each having a multiplicity of bristles. Advantageously, the pair of brushes each have a multiplicity of nylon bristles. Alternatively, the pair of resilient flexible members each comprise an elastomeric blade, desirably made of rubber. The housing front, top and side walls are preferably made of metal. Most desirably, the rear wall is made of plastic and said front wall has an inner ply made of plastic.

Most advantageously, at least one of said rear wall and said front wall has an inner surface which has a channel formed therein adjacent to said open bottom end of said housing which extends substantially the entire length of said at least one wall, and said fixed end of said at least one resilient, flexible member is slidably mounted in said channel and is configured and dimensioned to form a mechanical interlock with said channel to releasably lock said fixed end of said at least one resilient flexible member in place. Preferably said channel is substantially U-shaped and has a horizontally-extending upper sidewall and a horizontally-extending lower sidewall joined by a vertically-extending, recessed basewall wherein the lower sidewall of said channel is shorter than said upper sidewall which permits greater downward flexing of said at least one resilient flexible member.

In a particularly preferred embodiment of the invention, the means for resiliently and flexibly supporting and permitting manual dispensing of successive paper towels comprise a pair of opposing resilient, flexible members, one of which has said fixed end thereof mounted in said front wall and the other of which has said fixed end mounted in said rear wall. The pair of resilient and flexible members desirably comprises a pair of relatively thin, planar, elongated rectangular brushes, each having bristles, or a pair of relatively thin, planar, elastomeric blades. The pair of resilient and flexible members span substantially the length of the open bottom end, and each has a free end disposed opposite one another which together define an openable seam or dispensing slot therebetween through which the paper towels may be individually and successively dispensed from the bottom of the stack.

Certain of the foregoing and related objects are also attained according to the present invention by a method for making a paper towel dispenser ligature resistant of the type comprising a housing having a front panel, a rear panel, and a pair of side panels secured together to define a hollow, interior chamber configured and dimensioned for receipt therein of a stack of paper towels. The method comprises the steps of providing said housing with an open bottom end opening into said hollow interior chamber thereof through which a stack of paper towels may be inserted into said interior chamber. Mounted adjacent to said bottom open end of said housing are means for resiliently and flexibly supporting a stack of paper towels in said interior chamber and for permitting manual dispensing of successive individual paper towels from the bottom of the stack and downwardly from said interior chamber through and out of said open bottom end of said housing.

The method preferably additionally includes the step of manually inserting a stack of paper towels into said interior chamber of said housing through said open bottom end thereof and supporting said stack of paper towels on said means for resiliently and flexibly supporting said stack of paper towels and thereafter successively withdrawing one towel at a time through said open bottom end of said housing by pulling a paper towel past said means for resiliently and flexibly supporting said stack from the bottom of said stack causing said means to deflect downwardly upon dispensing of each towel.

The means for resiliently and flexibly supporting a stack of paper towels preferably comprises a pair of adjacent and opposing brushes which define an openable seam therebetween and wherein said method additionally includes the step of successively withdrawing said paper towels through said openable seam between said pair of brushes. Desirably, the means for resiliently and flexibly supporting a stack of paper towels comprises a pair of adjacent and opposing elongated, generally planar brushes or blades which define an openable seam therebetween and wherein said method additionally includes the step of successively withdrawing said paper towels through said openable seam between said pair of blades or brushes.

BRIEF DESCRIPTION OF THE SEVERAL VIEWS OF THE DRAWINGS

Other objects and features of the present invention will become apparent from the detailed description considered in connection with the accompanying drawings, which disclose several embodiments of the invention. It is to be understood that the drawings are to be used for the purpose of illustration only and not as a definition of the limits of the invention. In the drawings.

DETAILED DESCRIPTION OF THE INVENTION

Figure 1B:
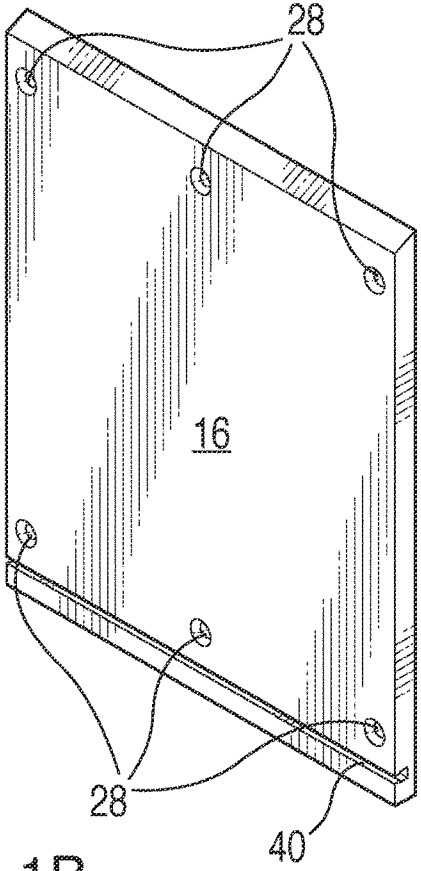
FIG. 1B is a top, front and right side isomeric view of the rear panel of the housing shown in FIG. 1A.
Figure 1A:
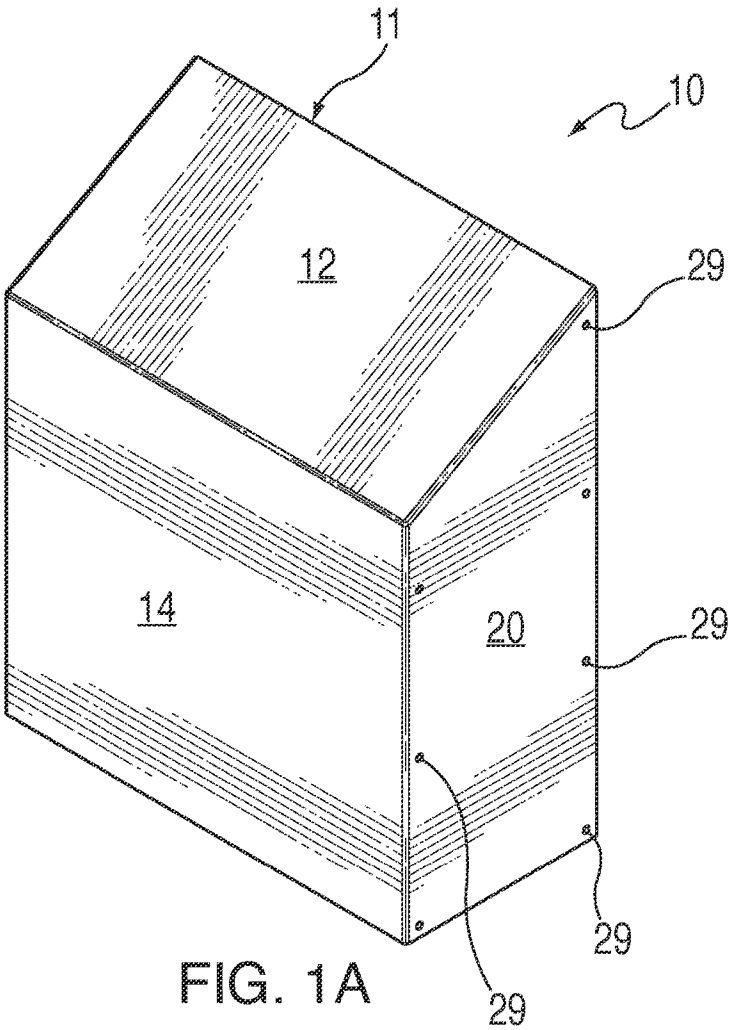
FIG. 1A is a top, front, and right-side isomeric view of a ligature-resistant, multifold, paper towel dispenser embodying the invention.
Figure 4:
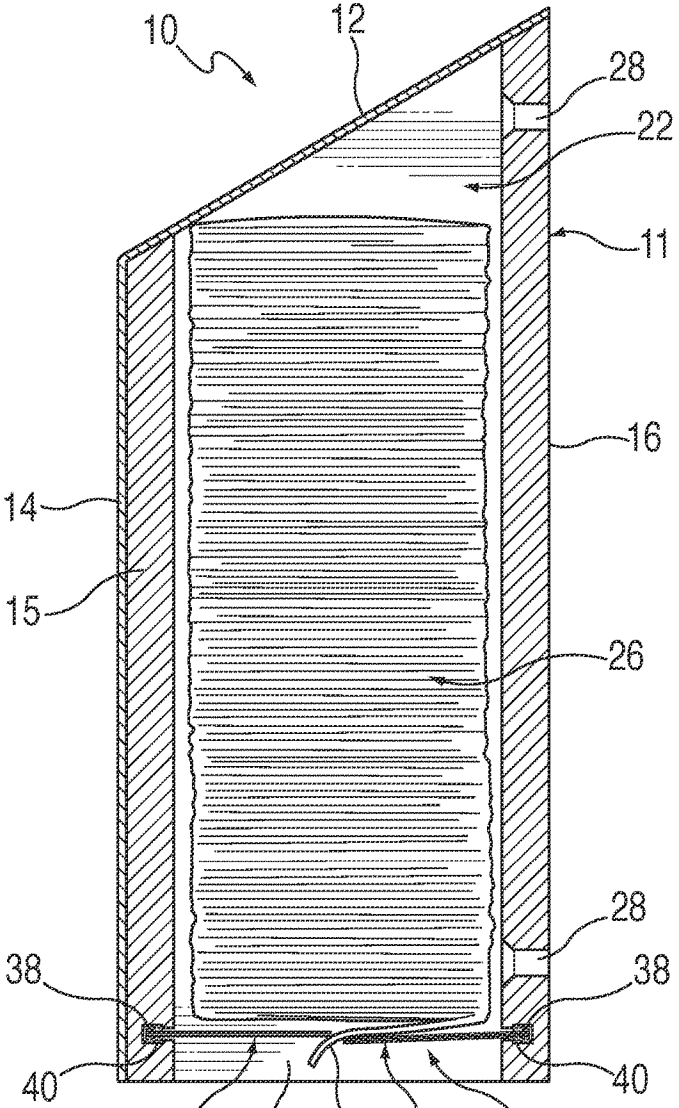
FIG. 4 is a cross-sectional view, in part elevation, of the dispenser of FIG. 3A showing a stack of paper towels within the housing chamber disposed above its opening bottom end taken along line 4-4 of FIG. 3A.

Turning now in detail to the drawings, therein illustrated is a ligature-resistant, multifold paper towel dispenser embodying the present invention. As shown in FIGS. 1A, 1B and 4, the paper towel dispenser generally designated 10, comprises a dispenser housing generally designated 11 having a top panel 12, a front panel 14, a rear panel 16, and a pair of side panels 18, 20 secured together to define a hollow, interior chamber 22 having an open bottom end 24. Bottom end 24 is suitably configured and dimensioned to accommodate a stack of multifold paper towels 26 inserted in said interior chamber 22 via said open bottom end 24. More specifically, the housing interior chamber 22 is suitably dimensioned and configured to permit a conventional and standard 250 sheet, rectangular, multifold paper towel bundle 26 to be inserted via the housing open bottom end 24 and supported therein, as hereinafter discussed. The housing front panel 14, top panel 12 and side panels 18, 20 are preferably made of metal, such as aluminum. Top panel 12 and front panel 14 are preferably made from one bent metal sheet. Preferably, the metal panels are provided with an anti-microbial powder coat. The rear panel 16 is preferably a plastic (e.g., PVC) panel and the front panel is provided with a similar plastic panel 15 secured to the inside surface thereof, the purpose for which will also be discussed in more detail below.

As seen best in FIG. 4, the dispenser 10 may be mounted to a vertical surface, including a wall (not shown), via screws, preferably flat head screws, or the like inserted through screw holes 28 formed in rear panel 16. For surface-mounted dispensers, the top panel 12 of the dispenser 10 is advantageously sloped 30 degrees from horizontal (or other appropriate angle) so that any ligature tie will slide off the top panel 12 and dispenser 10, The dispenser 10 may be recessed in the wall surface (not shown) so that a sloped top panel 12 is not required.

Figure 2A:
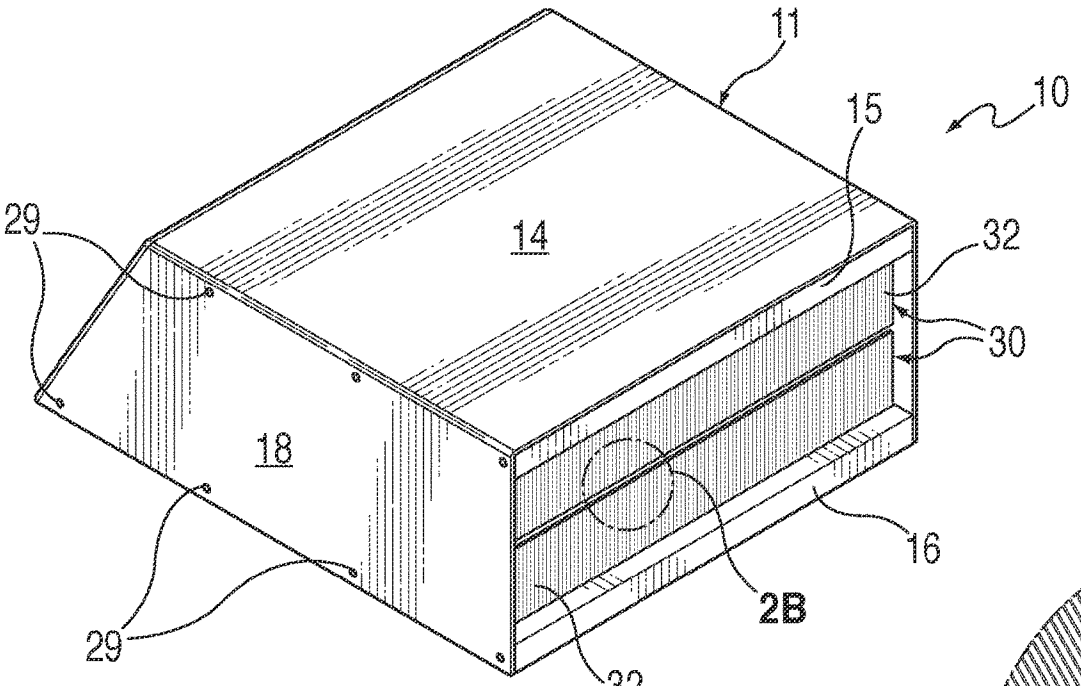
FIG. 2A is a bottom, front, and left-side isometric view of the dispenser shown in FIG. 1.
Figure 2B:
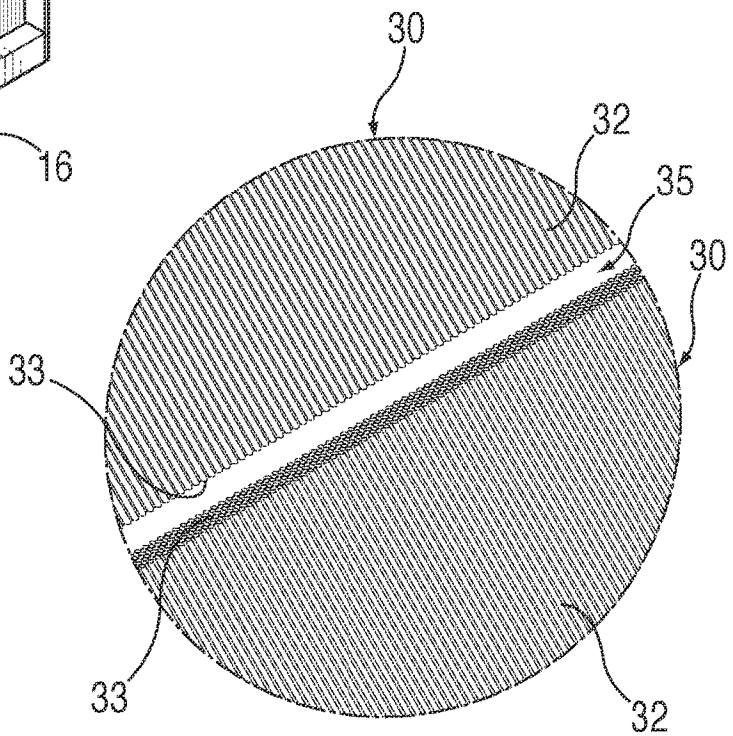
FIG. 2B is an enlarged view of the circular detail 2B in FIG. 2A which illustrates a portion of the pair of brushes having bristles which serve as the paper towel support and dispensing assembly of the dispenser shown in FIG. 2A.

FIGS. 2A, 2B and 3A, 3B illustrate alternate embodiments, respectively, of the paper towel support and dispensing assembly 30 for resiliently and flexibly supporting a stack of multifold paper towels 26 in said interior chamber 22 above said housing open bottom end 24 and for permitting successive manual dispensing of the lowermost individual multifold paper towel 27 from said open bottom end 24 of said interior chamber 22 of said housing 10 (FIG. 4). The paper towel support and dispensing assembly comprise a pair of elongated, resilient, flexible planar rectangular members 30 each having a free end 33 and an opposite fixed end 38. In FIGS. 2A and 2B, members 30 comprise brushes 32 having level or straight bristles and, alternatively, in FIGS. 3A and 3B, assembly 30 comprises a pair of elastomeric rectangular blades 34. Both pairs are designed to support the stack of paper towels 26 and permit dispensing of successive individual paper towels 27 one at a time from said open bottom end 24 of the dispenser 10.

Figure 5A:
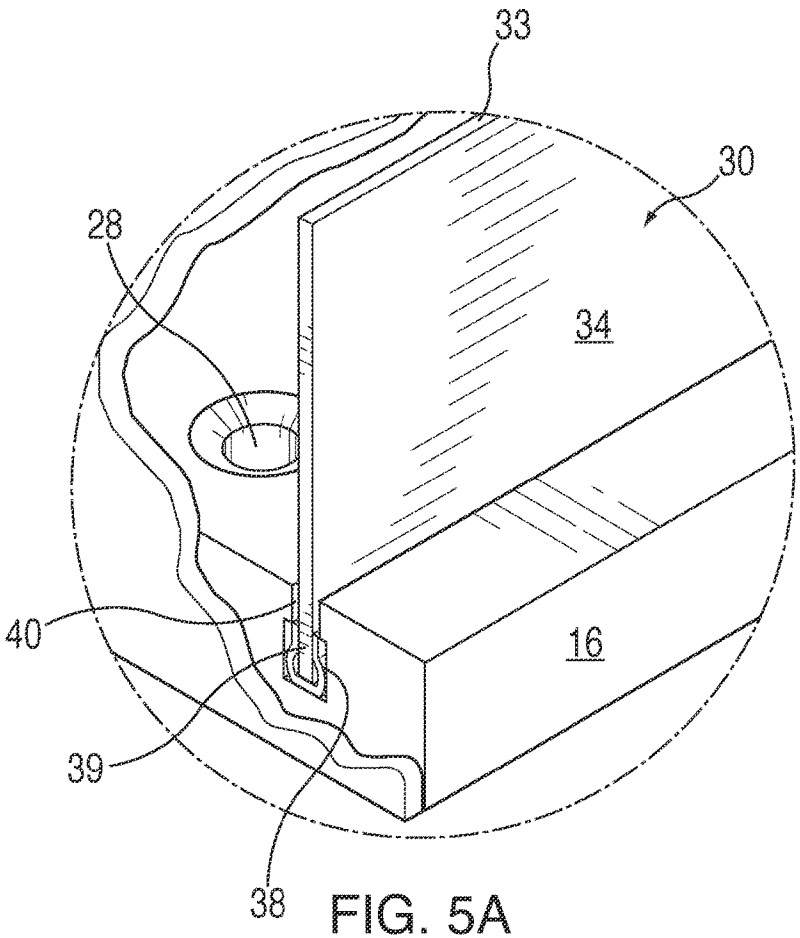
FIG. 5A is an enlarged, isometric view, with portions broken away, of the circular detail 5A in FIG. 3A with one of the pair of blades mounted in one of the housing panel's recessed channel.
Figure 5D:
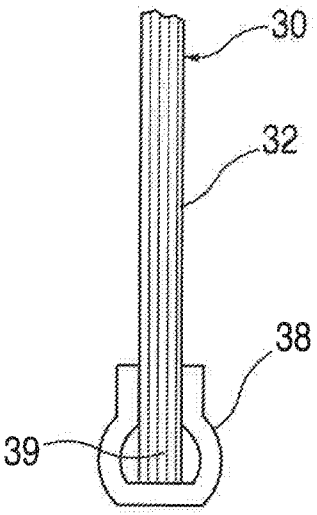
FIG. 5D is an enlarged, fragmentarily-illustrated, side elevational view of one of the brushes shown in FIG. 2A.
Figure 5C:
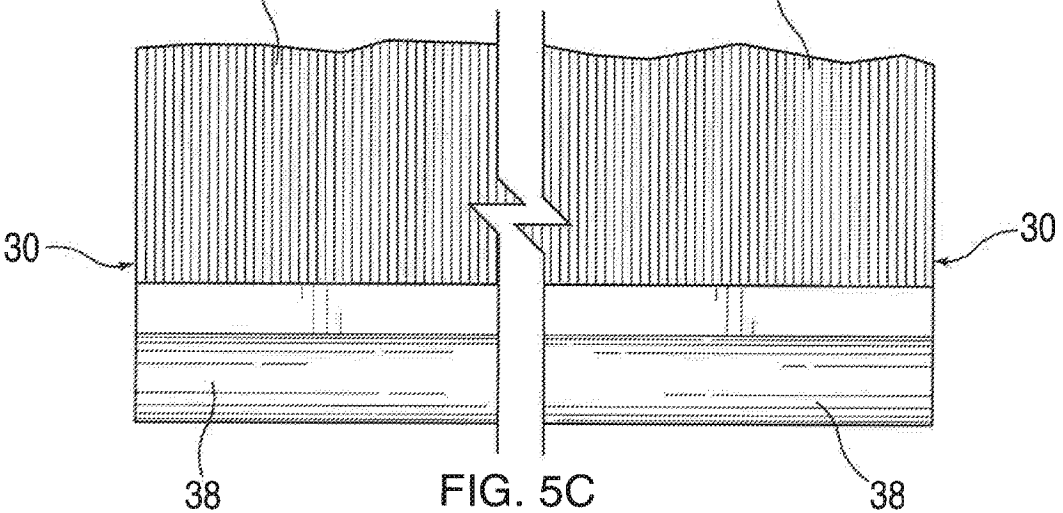
FIG. 5C is an enlarged, fragmentally-illustrated front elevational view of one of the planar, rectangular brushes shown in FIG. 2A.
Figure 5B:
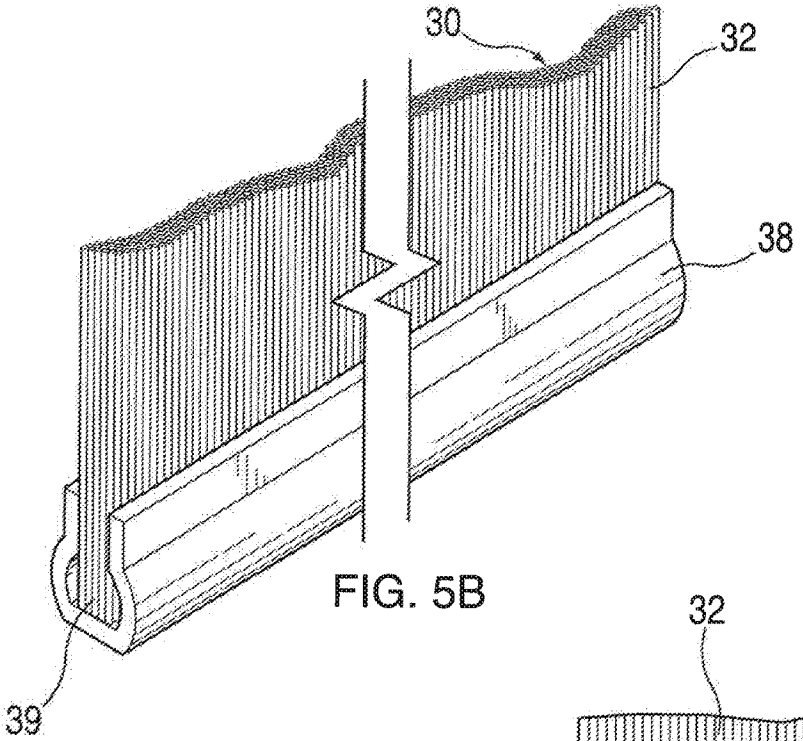
FIG. 5B is an enlarged, isometric front and left end view of the brush shown in FIG. 2A.

The brushes 32 are preferably straight nylon bristle brushes (FIG. 2B) and the preferably solid elastomeric rubber blades 34 (FIG. 5A) may be slotted 36 (FIG. 3B) to provide more flexible fingers which would function in a manner more comparable to the brushes 32 of FIGS. 2A and 2B. As seen best in FIGS. 5A and 5B, the brushes 32 and blades 34 each comprise a generally C-shaped, preferably metallic, spine or ferrule 38 which is clamped or crimped onto the heal end 39 of the brush 32 or blade 34. The heal ends 39 of the brushes 32 and blades 34 and the associated ferrule 38 are each slidably mounted into a recessed channel 40 in either the PVC inner substrate wall 15 or front panel 14 and/or the PVC rear wall 16, respectively, provided adjacent to the open bottom end 24 of the housing 10.

As can be appreciated, the ferrule 38 of the brush 32 or blade 34 can be slid into either recessed channel 40 of the front PVC inner panel 15 or the PVC rear panel 16, respectively, before the housing parts are assembled so that it is held in place by the mechanical interlock of the enlarged ferrule 38 of the brush 32 or blade 34 and the recessed channel 40 of the respective front and rear panels 15, 16 when so installed and in use. The brushes 32 and blades 34 can likewise be removed and replaced, when needed, by simply sliding them off one end of the channels 40 after the housing 10 is dismantled.

Figure 3A:
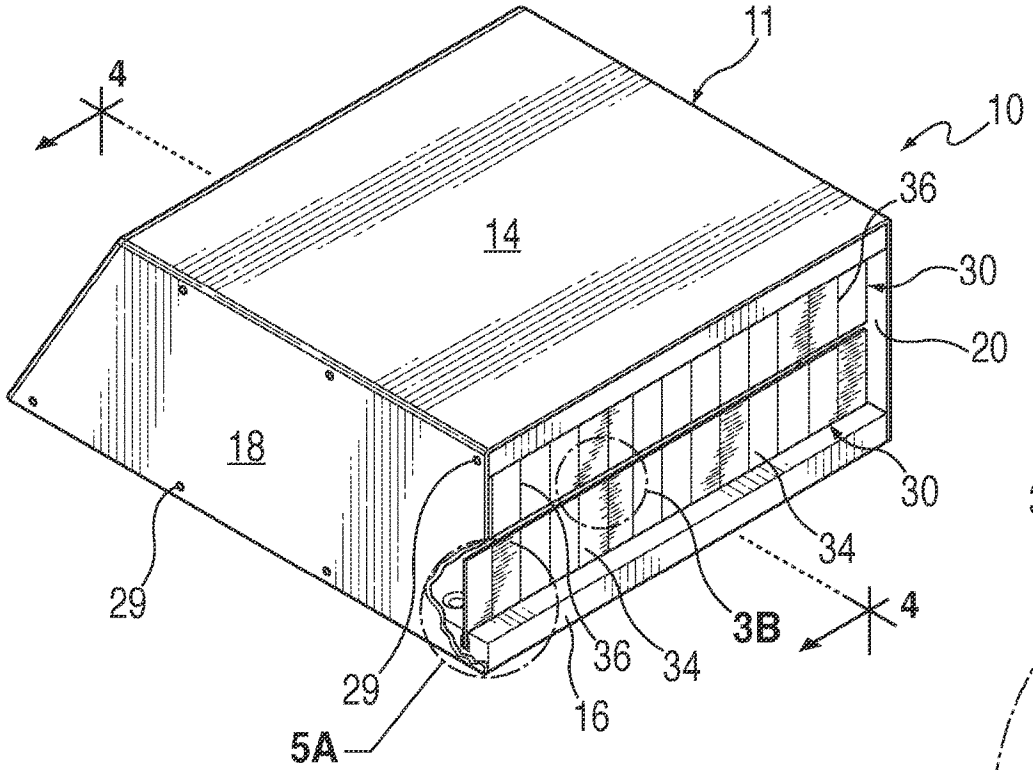
FIG. 3A is a bottom, front, and left-side isometric view of another embodiment of the invention comparable to the dispenser shown in FIG. 2.
Figure 3B:
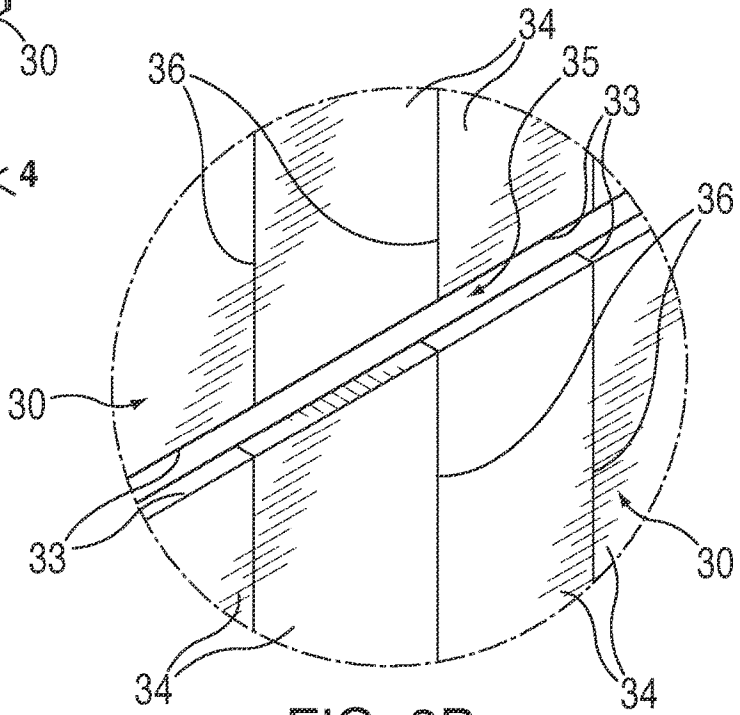
FIG. 3B is an enlarged view of the circular detail 3B in FIG. 3A which illustrates a portion of the pair of solid and/or slotted blades which serve as the paper towel support and dispensing assembly of the dispenser shown in FIG. 3A.
Figures 6A, 6B, 6C, 6D:
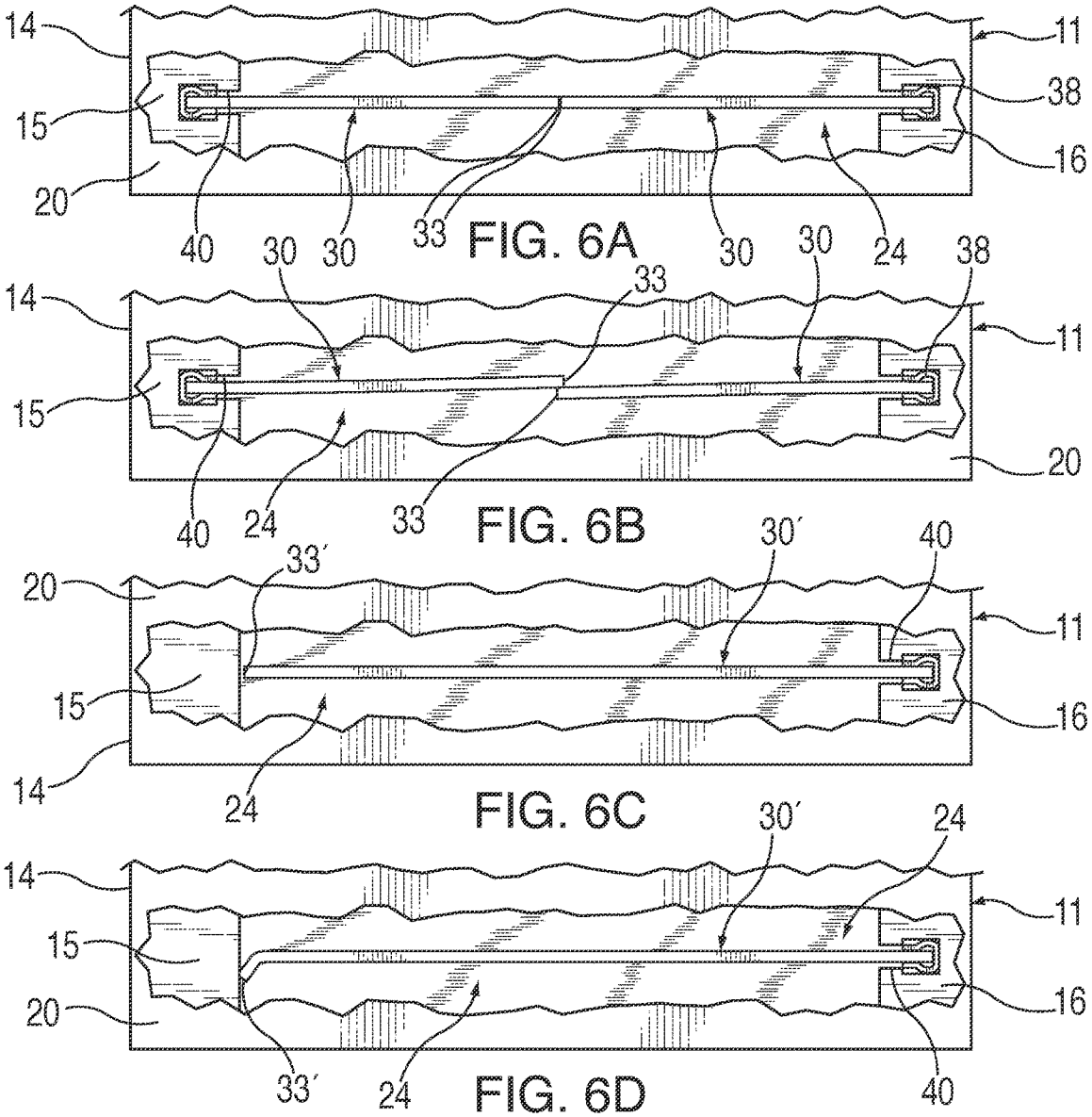
FIG. 6A is an enlarged fragmentally-illustrated, elevational view, in part section, and with portions broken away, of the open bottom end portion of the housing shown in FIG. 4, illustrating the free ends of the pair of resilient members abutting one another.
FIG. 6B is a view similar to FIG. 6A, but showing the free ends of the pair of resilient members overlapping one another.
FIG. 6C is a view comparable to FIGS. 6A and 6B, but showing the employment of only one resilient member, instead of two, with its free end spaced slightly short of the inner surface of the housing front panel.
FIG. 6D is a view similar to that of FIG. 6C, but showing the bent free end of the resilient member abutting the inner surface of the housing front panel.

As also shown in FIGS. 2B and 3B, the free ends or toes 33 of the generally planar, thin brushes 32 or blades 34 can be slightly spaced apart to define a discharge opening 35 therebetween. As can further be seen in FIGS. 6A 6B, the resilient, flexible members 30, whether a pair of brushes 32 or the blades 34, can also be arranged side-by-side, with their inner free ends 33 abutting one another (FIG. 6A) or slightly overlapping one another (FIG. 6B). Due to the flexibility of the brushes 32 or blades 34, a stack of multifold towels 26 can be inserted into the inner chamber 22 of the housing 10 by simply pushing the flexible brush bristles of brushes 32 or blades 34 upwardly until the entire paper towel stack 26 is completely raised into the inner housing chamber 22 above the free ends 33 of the brushes or blades, at which point the flexible brushes 32 or blades 34 then are free to resiliently return to their original horizontal supporting position to block or span the open bottom end 24 and also resiliently support the stack 26 in the inner chamber 22 with the bottom of the stack being resiliently supported atop the upper face of the brushes 32 or blades 34. To then permit successive individual dispensing of the multifold stack of paper towels 26, the installer would reach through the bristles 32 or blades 34 and grab the edge of the lowermost sheet 27 of the stack of paper towels (FIG. 4) and pull it downwardly so that it is free and projects through and below opening 35. Following manual removal by the user grabbing and pulling down the free end of the lowermost sheet 27 from the open bottom end 24 of the dispenser 10, the next sheet of the multifold stack 26 should be automatically pulled down at the same time so that its free end is partly exposed below the bottom lower face of the bristles 32 or blades 34, just like the former lowermost sheet 27 to thereby continue dispensing of the sheets one at a time, FIGS. 6C and 6D show two alternative arrangements of the invention where the paper towel support and dispensing assembly 30' comprises instead of a pair of brushes 32 or blades 34, only one brush 32 or blade 34. In these embodiments, the assembly 30' in the form of either brush 32 or blade 34 spans a majority or the entirety of the open bottom end 24 with its ferrule 38 received in the recessed channel 40 of only one of the PVC panels 15 or 16, such that its free end 33 is spaced from the opposite or front wall panel 15 (FIG. 6C) or such that it slightly overlays the opposite PVC panel 15 (FIG. 6D) so that it may flex upwardly for insertion of the stack 26 into the inner housing chamber 22, and, in turn, flex downwardly so that it is in position to allow for dispensing of a single paper towel between the opposite front or rear wall 15, 16 and the free end 33 of the brush 32 or blade 34, as otherwise heretofore described.

It is important that the resilient flexible member(s) 30, 30' whether it be a brush 32 with individual bristles, or a solid or segmented blade 34 having separate blade-like fingers or any other suitable resilient flexible member(s) sufficiently spans the rectangular bottom opening 24 to a degree necessary to support the stack of paper towels and permit individual dispensing of the towels one-by-one through the open bottom end 24. For ease of construction and efficient operation, it is preferred that the brush 32 or blades 34 span the entire span or substantially the entire span of the open bottom end 24 of the housing.

Figure 7A:
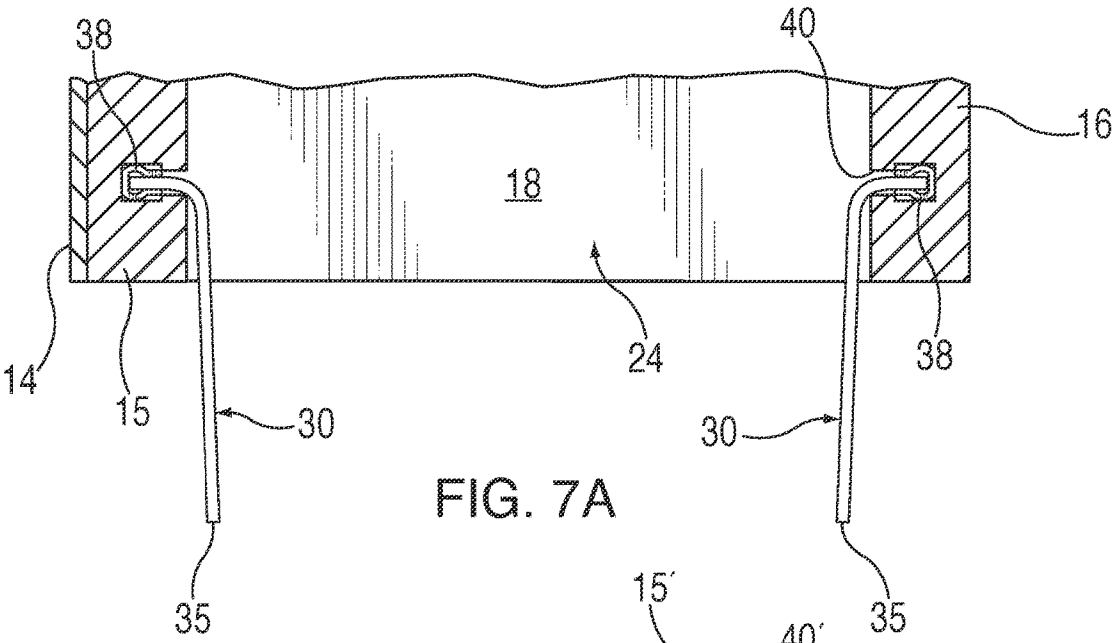
FIGS. 7A and 7B are fragmentally-illustrated, side sectional views of the lower end portion of the housing, showing in FIG. 7A the maximum downward effective deflection of the brushes or blades utilizing the housing and channel configuration as shown in FIGS. 4 and 5 and showing a greater maximum deflection utilizing a modified housing and channel configuration as shown in FIG. 7B.
Figure 7B:
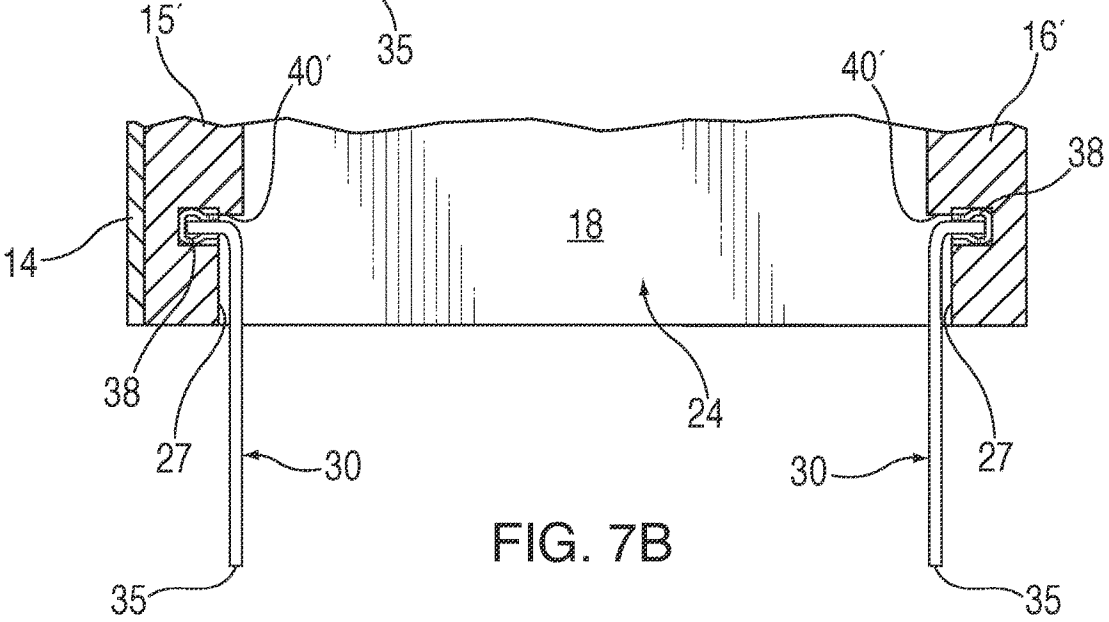

As shown schematically in FIGS. 7A and 7B, the degree of downward flexure of the resilient, flexible member 30, whether brushes 32 or blades 34, may be increased by reducing the width of the inside face of the front or rear wall, 15, 16 below the horizontally-extending channels 40. FIG. 7A shows the degree of flexure permitted by the housing 11 shown in FIGS. 1-7. Due to the fact that the walls of the front panel 15 and rear panel 11 are uniform, the flexure of the brush 32 or blade 34 must necessarily bend downward in a manner that restricts or reduces the effective width of the dispensing opening 24 to the distance between the two downwardly extending members 30 which is less than the width of the opening 24. On the other hand, as shown in FIG. 7B the resilient members 30 can flex almost vertically downwardly, due to the inner bottom ends of the front or rear walls, 15', 16' being reduced in width to thereby present a wider lower open bottom end 24. As a result, there is no constriction or reduction of the effective width of the open bottom end 24 to interfere with the loading and dispensing of the stack of paper towels and the individual dispensing thereof. This is critical because the point of the invention is to avoid a restrictive opening.

For example, in a preferred embodiment, the width of the open bottom end is 3.5 inches to accommodate loading and dispensing of a standard paper towel stack of 250 sheets. Since each brush 32 or blade 34 preferably has a width of 0.1 inches, the housing configuration shown in FIG. 7A results in a narrowing of the opening from 3.5 inches to 3.3 inches. However, the housing configuration in FIG. 7B maintains the opening at 3.5 inches due to its greater degree of downward flexure.

Most desirably, the brushes 32 comprise 0.014 inch diameter nylon bristles mounted in a galvanized or stainless steel ferrule 39. The use of flexible, resilient brushes typically guide attempted ligature anchor points to pass between the bristles in addition to deflecting them downward. Nylon bristles are a relatively soft material that is comfortable for fingers and hands. The maximum width of the flexible member or membrane 30 is therefore the thickness of the bristles themselves.

The length of the bristles or blades is preferably the same so that they form an openable or dispensing slot in the middle of the bottom end opening, but their length could be different to move the operable slot 35 either forward or rearward section relative to the bottom open end 24. Most desirably, each brush or blade may have a 9.5 inch length and may have a 2 inch overall height. In accordance with some embodiments, a single 3.75 inch tall brush can be used so that the dispensing slot or openable slot is against the front wall 14, 15 or the back wall 16. As mentioned above, the mat of bristles are preferably straight and level and are preferably in the general range of about 0.05 to 0.1 inches thick.

In a preferred embodiment, the overall dimensions of the dispenser housing is 11.5" height×9.5" width. The exterior of the housing is made preferably from an 11 gauge aluminum sheet with a white anti-microbial coating. The interior PVC panels are preferably about ¾" thick. Preferably, the rectangular dimensions of the dispensing cavity in the horizontal plane are 3.5 inches×9.5 inches to accommodate the size of standard multifold paper towels (approximately 3.25 inches×9.25 inches when folded). In some embodiments, the minimum inside height of the dispensing cavity is 9 inches to accommodate the height of a standard stack of multifold paper towels (6 inches) plus an additional clearance space to allow the stack of paper towels to be pushed past the ends of the upward deflected bristles during the loading process.

The dispenser may be mounted to a surface using screws (not shown), securing said rear panel 16 to a surface as a first step. Said surface may include pre-drilled holes. Securing said rear panel 16 to said wall surface may include installing preferably six ¼" flat head screws (not shown) through said pre-drilled screw holes 28 formed through rear panel 16. The front panel 14 and top panel 12 are preferably made from one metal sheet bent to integrally form and join both panels 12 and 14 together. The inner PVC panel 15 of front panel 14 are secured to side panels 18, 20 via button head screws 29.

As can be readily appreciated, this dispenser advances the state of the art by employment of a flexible resilient material to serve simultaneously as the resilient support for the stacked paper towels, as well as a movable, flexible "gate" for the loading/dispensing bottom opening. Consequently, an object inserted into the dispenser 10 as a ligature attachment point would necessarily lie upon this flexible "gate" and when weight or force is applied to it, it would deflect downwardly causing the object to slip off this flexible "gate" and off the dispenser to prevent it from serving as a ligature attachment point. Use of a brush enjoys the additional benefit of flexible bristles which cannot easily be punctured or tied so they afford greater ligature resistance than the use of solid or slotted rubber blades. The degree of flexure is primarily dependent upon the thickness of the flexible material, whether a brush or blade and both are still therefore much less likely to act as a ligature attachment anchor point than paper towel dispensers currently in existence.

While the preferred embodiment of the ligature-resistant, paper towel dispenser has been described in detail, it should be apparent that modifications and variations thereto are possible, all of which fall within the true spirit and scope of the invention. With respect to the above description then, it is to be realized that the optimum functionality for the components of the invention, to include variations in dimensions and functionality are deemed readily apparent and obvious to one skilled in the art.

For example, the outer exposed surfaces of the dispenser may be stainless steel or powder-coated aluminum with no sharp corners, edges, or seams. In some embodiments, "tamper-proof" security style fasteners may be used. Security caulk may be used around sides of the dispenser as an added form of limiting exposure of the outer surfaces of the dispenser.

Descriptions of technical features or aspects of an embodiments may be described using the United States customary units, which include, inter alia, inches. Accordingly, technical features or aspects of embodiments described herein should be interpreted to include both the corresponding conversion of United States customary units to the metric system units, which include, inter alia, centimeters and millimeters.

While particular embodiments of the invention have been described, it is not intended that the invention be limited thereto, as it is intended that the invention be as broad in scope as the prior art will allow and that the specification be read likewise. It will therefore be appreciated by those skilled in the art that other modifications could be made thereto without departing from the spirit and scope of the invention.

What is claimed is:

1. A ligature-resistant, paper towel dispenser, comprising:

a housing having a top panel, a front panel, a rear panel, and a pair of side panels secured together to define a hollow, interior chamber configured and dimensioned for receipt therein of a stack of paper towels, said housing having an open bottom end having a width greater than the entire a stack of paper towels to be inserted there-through into said interior chamber thereof; and means for resiliently and flexibly supporting a stack of paper towels from below the stack of paper towels in said interior chamber above said open bottom end of said housing and for permitting manual dispensing of successive individual paper towels from the bottom of said stack and from said interior chamber downwardly through and out of said open bottom end of said housing, said means for resiliently and flexibly supporting and permitting manual dispensing of successive paper towels comprises at least one resilient, flexible member having a fixed end secured in said housing adjacent to said open bottom end thereof and an opposite free end, said at least one resilient flexible member is mounted in said housing perpendicular to said front and rear panels and is disposed to transversely span a majority of said open bottom end of said housing to support from below a stack of paper towels disposed thereabove, and said free end of said at least one resilient flexible member is movable upwardly relative to said open bottom end to permit insertion of a stack of paper towels into said interior chamber with said free end of said resilient flexible member being movable downwardly to permit successive removal of paper towels one at a time through said open bottom end of said housing, wherein, at least one of said rear panel and said front panel has an inner surface having a recessed channel formed therein adjacent to said open bottom end of said housing which extends transversely of said at least one panel and along substantially the entire width of said at least one panel, and said fixed end of said at least one resilient, flexible member is slidably mounted in said recessed channel and is configured and dimensioned for forming a mechanical interlock with said channel for releasably locking said fixed end of said at least one resilient flexible member in said channel and, in turn, in at least one of said rear panel and said front panel.

2. The paper towel dispenser according to claim 1, wherein said housing front, top and side panels are made of metal.

3. The paper towel dispenser according to claim 1, wherein said rear panel is made of plastic and said front panel has an inner ply made of plastic.

4. The paper towel dispenser according to claim 1, wherein:

said channel is substantially U-shaped and has a horizontally-extending, upper sidewall, a horizontally-extending lower sidewall, and a vertically-extending basewall joined to both of said sidewalls; and said lower sidewall of said channel is shorter than said upper sidewall thereof which permits greater downward flexing of said resilient flexible member.

5. The paper towel dispenser according to claim 1, wherein said at least one resilient, flexible member comprises a brush having bristles.

6. The paper towel dispenser according to claim 1, wherein said at least one resilient, flexible member comprises a blade.

7. A ligature-resistant, paper towel dispenser, comprising:

a housing having a top panel, a front panel, a rear panel, and a pair of side panels secured together to define a hollow, interior chamber configured and dimensioned for receipt therein of a stack of paper towels, said housing having an open bottom end through which a stack of paper towels may be inserted into said interior chamber thereof; and means for resiliently and flexibly supporting a stack of paper towels in said interior chamber above said open bottom end of said housing and for permitting manual dispensing of successive individual paper towels from the bottom of said stack and from said interior chamber downwardly through and out of said open bottom end of said housing, wherein said means for resiliently and flexibly supporting and permitting manual dispensing of successive paper towels comprises at least one resilient, flexible member having a fixed end secured in said housing adjacent to said open bottom end thereof and an opposite free end, said at least one resilient flexible member spanning at least a portion of said open bottom end of said housing to support a stack of paper towels disposed thereabove, and wherein said free end of said at least one resilient flexible member is movable upwardly relative to said open bottom end to permit insertion of a stack of paper towels into said interior chamber and wherein said resilient flexible member is movable downwardly to permit successive removal of paper towels one at a time through said open bottom end of said housing;

at least one of said rear panel and said front panel has an inner surface which has a channel formed therein adjacent to said open bottom end of said housing which extends substantially the entire width of said at least one panel;

said fixed end of said at least one resilient, flexible member is slidably mounted in said channel and is configured and dimensioned to form a mechanical interlock with said channel to releasably lock said fixed end of said at least one resilient flexible member in said channel; and said channel being substantially U-shaped and having a horizontally-extending, upper sidewall, a horizontally-extending lower sidewall, and a vertically-extending basewall joined to both of said sidewalls, and wherein said lower sidewall of said channel is shorter than said upper sidewall thereof which permits greater downward flexing of said resilient flexible member.

8. The paper towel dispenser according to claim 1, wherein said housing is rigid and has a fixed rectangular cross-sectional profile with said front and rear walls being parallel to one another and said side panels being parallel to one another, and wherein said hollow, interior chamber is bounded solely by the top, front, rear and side panels of said housing and at its open bottom end solely by said at least one resilient, flexible member to minimize the likelihood of creating a ligature attachment point in the housing or near the bottom open end thereof, thereby enhancing the ligature resistance of the paper towel dispenser.

* * * * *